US009941037B2

(12) United States Patent
Sanchez Llamazares et al.

(10) Patent No.: US 9,941,037 B2
(45) Date of Patent: Apr. 10, 2018

(54) MAGNETOCALORIC MATERIAL BASED ON NDPRFE$_{17}$ WITH IMPROVED PROPERTIES

(71) Applicant: Instituto Potosino de Investigación Cientifica y Tecnológica A.C., San Luis Potosi (MX)

(72) Inventors: Jose Luis Sanchez Llamazares, San Luis Potosi (MX); Cesar Fidel Sanchez Valdes, San Luis Potosi (MX); Pablo Jesus Ibarra Gaytan, Zacatecas (MX)

(73) Assignee: Instituto Potosino De Investigacion Cientifica y Tecnologica A.C., San Luis Potos (MX)

( * ) Notice: Subject to any disclaimer, the term of this patent is extended or adjusted under 35 U.S.C. 154(b) by 484 days.

(21) Appl. No.: 14/590,069

(22) Filed: Jan. 6, 2015

(65) Prior Publication Data

US 2015/0194245 A1 Jul. 9, 2015

Related U.S. Application Data

(60) Provisional application No. 61/923,962, filed on Jan. 6, 2014.

(51) Int. Cl.

| | |
|---|---|
| ***H01F 1/01*** | (2006.01) |
| ***C22C 45/02*** | (2006.01) |
| ***C22C 38/00*** | (2006.01) |
| ***B22D 11/06*** | (2006.01) |
| ***C22C 33/00*** | (2006.01) |

(52) U.S. Cl.

CPC ..... *H01F 1/015* (2013.01); *B22D 11/0611* (2013.01); *C22C 33/003* (2013.01); *C22C 38/005* (2013.01); *C22C 45/02* (2013.01)

(58) Field of Classification Search

CPC ... H01F 1/015; B22D 11/0611; C22C 33/003; C22C 38/005; C22C 45/02

See application file for complete search history.

(56) References Cited

U.S. PATENT DOCUMENTS

| | | | | |
|---|---|---|---|---|
| 5,743,095 | A | 4/1998 | Gschneider, Jr. | |
| 5,948,179 | A * | 9/1999 | Hasegawa ..... | H01F 1/055 148/301 |
| 6,589,366 | B1 | 7/2003 | Gschneider, Jr. | |

(Continued)

OTHER PUBLICATIONS

Pedro Gorria, José L Sánchez Llamazares, Pablo Álvarez, María José Pérez, Jorge Sánchez Marcos, Jesús A. Blanco, "Relative cooling power enhancement in magneto-caloric nanostructured Pr2Fe17", J. Phys D: Appl. Phys., vol. 41 (2008) 192003.

(Continued)

*Primary Examiner* — Colleen P Dunn

(74) *Attorney, Agent, or Firm* — Defillo & Associates, Inc.; Evelyn A Defillo

(57) ABSTRACT

The instant invention relates to a magnetocaloric material based on NdPrFe$_{17}$ melt-spun ribbons. This material has improved properties when compared with other similar magnetocaloric (MC) materials since it has an enhanced refrigeration capacity in the room temperature range due to its broader magnetic entropy change as function of the temperature curve. This material is useful as magnetic refrigerant as a part of magnetocaloric refrigerators.

8 Claims, 3 Drawing Sheets

(56) References Cited

U.S. PATENT DOCUMENTS

| | | | | |
|---|---|---|---|---|
| 2006/0231163 | A1* | 10/2006 | Hirosawa | H01F 1/015 148/105 |
| 2011/0041513 | A1* | 2/2011 | Reesink | C22C 19/07 62/3.1 |
| 2012/0282130 | A1 | 11/2012 | Gschneider, Jr. | |

OTHER PUBLICATIONS

Pedro Gorria, Pablo Álvarez, Jorge Sánchez Marcos, José L. Sánchez Llamazares, María J. Pérez, Jesús A. Blanco, "Crystal structure, magnetocaloric effect and magnetovolume anomalies in nanostructured Pr2Fe17", Acta Materialia, vol. 57 (2009) 1724-1733.

Pablo Álvarez, Pedro Gorria, Victorino Franco, Jorge Sánchez Marcos, María José Pérez , José L. Sánchez Llamazares, Inés Puentes Orench, Jesús A. Blanco, "Nanocrystalline Nd2Fe17 synthesized by high-energy ball milling: crystal structure, microstructure and magnetic properties", J. Phys.: Condens. Matter vol. 22 (2010) 216005.).

K.A. Gschneider Jr. et al. (J. Appl. Physics), "Magnetic Refrigeration Materials (Invited)", vol. 85, No. 8 pp. 5365-5368) 1999.

M. E. Wood and W. H. Potter, "Cryogenics", vol. 25 (1985) 667-683.

K.A. Gschneider Jr. et al. (Institute of Physics), "Recent Development in Magnetocaloric Materials"; vol. 68, pp. 1479-1539) 2005.

Liu Min et al. (J. Cent South Univ, Technol); "Devlopment of Magnetocaloric Materials in Room Temperature Magnetic Refrigeration Application in Recent Six Years" (2009) 16: 0001-0012.

* cited by examiner

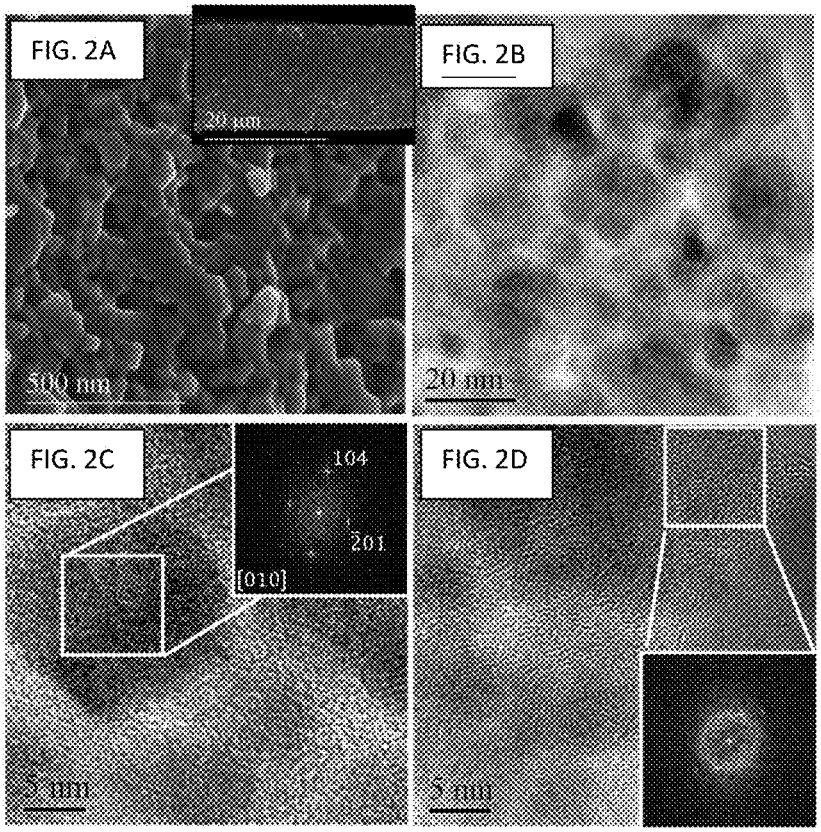
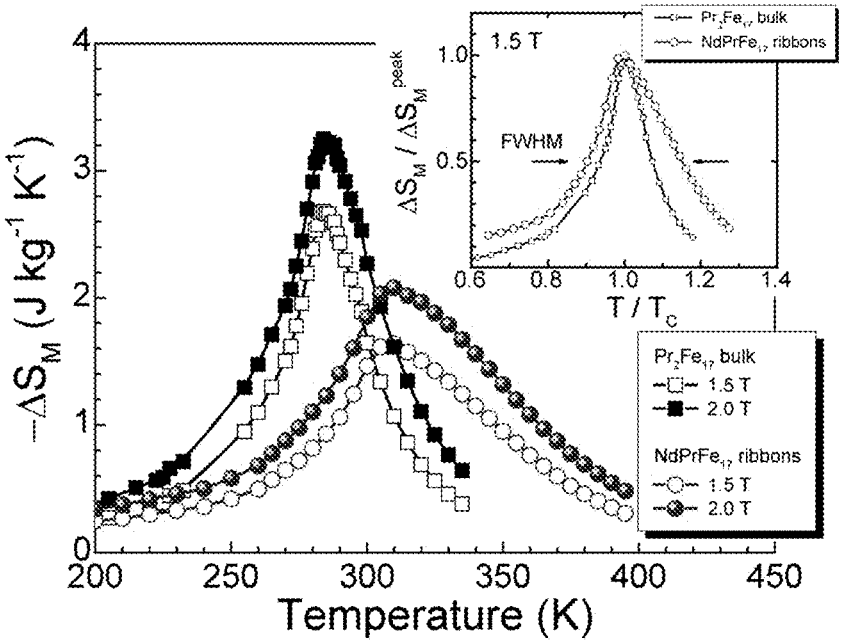
FIG. 3

MAGNETOCALORIC MATERIAL BASED ON $NDPRFE_{17}$ WITH IMPROVED PROPERTIES

CROSS-REFERENCE TO RELATED APPLICATIONS

This application claims the benefit of priority to U.S. Provisional Application No. 61/923,962 filed Jan. 6, 2014, the contents of which is incorporated herein by reference.

FIELD OF THE INVENTION

The instant invention is related with a magnetocaloric material based on $NdPrFe_{17}$ melt-spun ribbons. This material has improved properties when compared with other similar magnetocaloric (MC) materials since it has an enhanced refrigeration capacity in the room temperature range due to its broader magnetic entropy change as function of the temperature curve. This material is useful as magnetic refrigerant as a part of magnetocaloric refrigerators.

BACKGROUND OF THE INVENTION

Magnetic refrigeration is a cooling refrigeration technology based on the magnetocaloric effect.

The refrigerant capacity RC is a main figure of merit for characterizing the magnetocaloric response of any magnetic refrigerant since it measures the amount of heat that can be transferred from the cold to the hot sink during an ideal refrigeration cycle. In practice, a large refrigerant capacity depends on having a broad magnetic entropy change as function of the temperature curve, $[\Delta S_M(T)]$.

Hence, any increase in the temperature that define the full-width at half-maximum of the curve results in an enhancement of RC.

Magnetic refrigeration is currently of interest since it both, more efficient from the energy point of view (up to a 30%) and environment-friendly in comparison with the conventional gas-based refrigeration; thus it is economically and environmentally convenient.

Some of the reported magnetocaloric materials such as MnAs and $MnFeP_{0.45}As_{0.55}$ with favourable magnetocaloric effect in a temperature range from 250 to 320 K (U.S. Pat. No. 7,069,729B2), contain toxic elements such as Arsenic which could be dangerous for domestic uses. K. A. Gschneider Jr. et al. (J. Appl. Physics, Vol. 85, No. 8 pp. 5365-5368), describes materials with a large magnetocaloric effect based on Gd and its alloys such as those in the ternary alloy system Gd—Si—Ge (U.S. Pat. No. 6,589,366B1, or U.S. Pat. No. 5,743,095).

Pr and Nd are known for their use in commercial permanent magnet alloys based on the tetragonal 2:14:1 Fe-based ternary compounds (i.e., $Nd_2Fe_{14}B$ and $Pr_2Fe_{14}B$) (US2012282130A1). However, they have not been used in a 2:17 alloy such as $NdPrFe_{17}$, as in the instant invention, nor the magnetocaloric properties were disclosed or measured.

The binary intermetallic compounds $R_2Fe_{17}$ with R=Nd or Pr are collinear ferromagnets with a high saturation magnetization (i.e., 185 and 192 $Am^2kg^{-1}$ at 5 K, respectively), and Curie temperature around room temperature (285±5 and 335±5 K, respectively). The interest to consider them as potential candidates for room-temperature magnetic refrigeration lies in their low rare-earth content (in comparison with other rare-earth containing alloys). Until now, the assessment of their MC properties has been focused on bulk alloys produced by arc melting followed by a prolonged high-temperature thermal annealing (several days in the 1273-1373 K temperature range) and powdered ball-milled nanocrystalline alloys. (Pedro Gorria, José L. Sánchez Llamazares, Pablo Álvarez, María José Pérez, Jorge Sánchez Marcos, Jesús A. Blanco, "Relative cooling power enhancement in magneto-caloric nanostructured $Pr_2Fe_{17}$", J. Phys D: Appl. Phys., Vol. 41 (2008) 192003; Pedro Gorria, Pablo Álvarez, Jorge Sánchez Marcos, José L. Sánchez Llamazares, María J. Pérez, Jesús A. Blanco, "Crystal structure, magnetocaloric effect and magnetovolume anomalies in nanostructured $Pr_2Fe_{17}$", Acta Materialia, Vol. 57 (2009) 1724-1733; Pablo Álvarez, Pedro Gorria, Victorino Franco, Jorge Sánchez Marcos, María José Pérez, José L. Sánchez Llamazares, Inés Puentes Orench, Jesús A. Blanco, "Nanocrystalline $Nd_2Fe_{17}$ synthesized by high-energy ball milling: crystal structure, microstructure and magnetic properties", J. Phys.: Condens. Matter Vol. 22 (2010) 216005.) Also, in nanometer-sized $R_2Fe_{17}$ (R=Nd or Pr) powders produced by severe mechanical milling of single-phase bulk alloys, a moderate decrease in $|\Delta S_M^{peak}|$ together with the enlargement of both $\delta T_{FWHM}$ and RC has been observed (see three above references).

In the present invention, a magnetocaloric material comprising $NdPrFe_{17}$ melt spun ribbons is described. The resulting MC properties are compared with those reported for the bulk parent compound $Pr_2Fe_{17}$ to emphasize on the improved refrigerant capacity and working temperature range of the fabricated allow ribbons.

SUMMARY OF THE INVENTION

The invention describes and claims a magnetocaloric material, useful for room temperature magnetic refrigeration, comprising $NdPrFe_{17}$ melt spun ribbon. In said material each element is in stoichiometric proportions and is produced in ribbon form. Furthermore, said material is composed of nanocrystallites surrounded by an intergranular amorphous phase, showing two successive second-order ferromagnetic phase transitions of 303 and 332 K, wherein said transitions come from a rhombohedral $Th_2Zn_{17}$-type nanocrystallites and a minor amorphous intergranular phase. Additionally, said material has a magnetic entropy change curve with a the working temperature range $\delta T_{FWHM}$ of 84 K at $\mu_o\Delta H$=2 T.

The invention also comprises a method for the manufacture of said magnetocaloric material, comprising the step of melt-spinning the alloy to form a ribbon having a two phase microstructure consisting of a nanoscale crystalline phase and an amorphous phase, wherein the melt spinning technique is used for the step of rapid solidification in which ribbons forms by ejecting the molten metallic alloy onto a rotating copper wheel in Ar atmosphere.

BRIEF DESCRIPTION OF THE DRAWINGS

FIG. 2A shows a typical scanning electron microscope (SEM) micrographs of the ribbons cross-section.

FIGS. 2B-2D show transmission electron microscope (TEM) images of the alloy ribbons collected at different magnifications. In (c), a high resolution TEM image shows the lattice planes of a 2:17 nanograin; the Fourier transform of the square indicated area is shown in the inset. The spots are indexed according to the structure used for Rietveld refinement of FIG. 1A. FIG. 2D shows a high-resolution image shows that nanoparticles are surrounded by a disordered (amorphous) intergranular phase; the corresponding Fourier transform of the square is shown in the inset of the image.

FIG. 3 shows a graph with the temperature dependence of the magnetic entropy change $\Delta S_M(T)$ for magnetic field changes of 1.5 and 2.0 T for as-solidified $NdPrFe_{17}$ alloy ribbons. For the sake of comparison the curves exhibited by $Pr_2Fe_{17}$ bulk alloys are plotted. Inset: normalized temperature dependence of the magnetic entropy change as a function of $T/T_C$ for as-solidified $NdPrFe_{17}$ alloy ribbons compared to the curves for bulk $Pr_2Fe_{17}$ alloys. The horizontal arrows point to the full-width at half-maximum of the curves. The broadening of the curve observed for the fabricated alloy ribbons is due to the presence of the secondary intergranular amorphous phase.

DETAILED DESCRIPTION OF THE INVENTION

The magnetocaloric material of the invention is made from alloy ribbons of nominal composition $NdPrFe_{17}$ in stoichiometric proportions produced by rapid solidification using the melt spinning technique. Samples were produced under a highly pure Ar atmosphere from pure metallic elements (≥99.9%).

Alloy Constitution

Figure 1A:
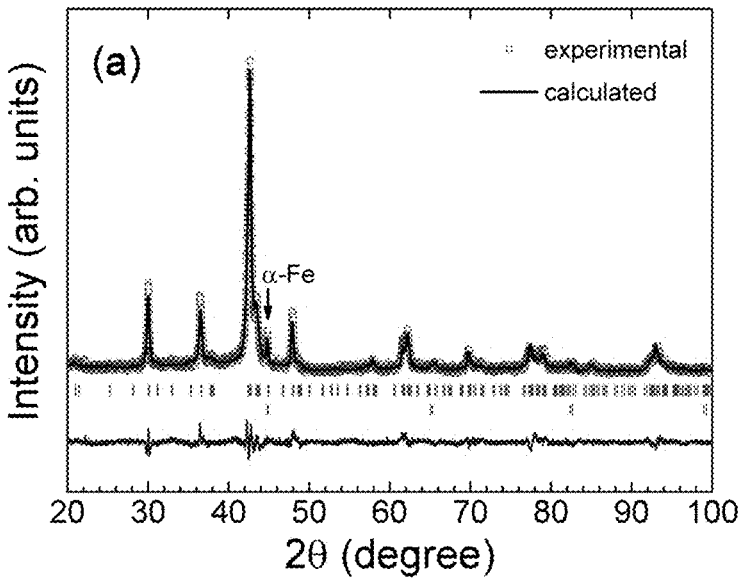
FIG. 1A shows a graph with experimental (red circles) and calculated (black line) X-ray powder diffraction pattern for as-quenched (aq) $NdPrFe_{17}$ alloy ribbons (Cu—$K_\alpha$ radiation). The difference line is depicted at the bottom of the figure. The second series of vertical green bars corresponds to the crystal structure of the impurity bcc a-Fe phase (~4 wt. %); the vertical arrow points to its more intense Bragg reflection.
Figure 1B:
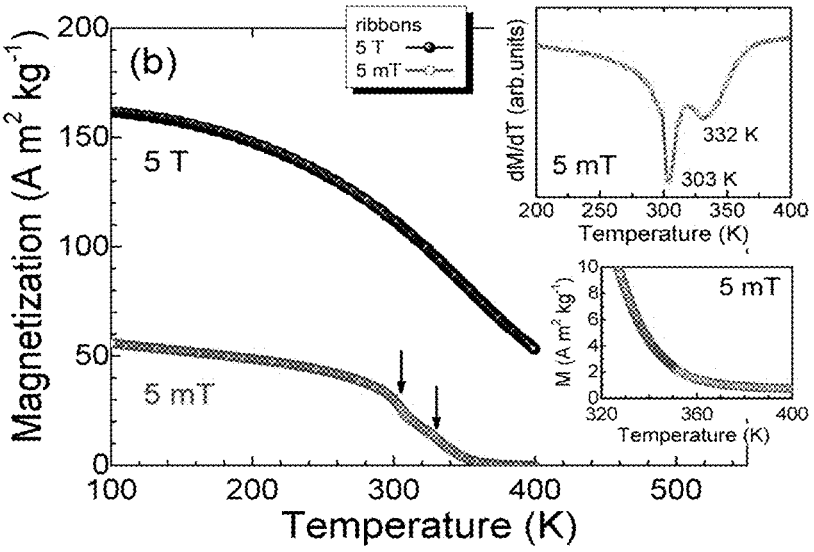
FIG. 1B shows a graph with the Temperature dependence of magnetization under a static magnetic field of 5 mT (red curve) and 5 T (black curve). The vertical arrows point to the magnetic transition of the 2:17 rhombohedral phase and the secondary amorphous phase. Top inset: dM/dT vs. T curve at 5 mT. Bottom inset: low-field M(T) curve between 320 and 400 K.

Energy dispersive spectroscopy analyses revealed that the starting chemical composition, namely $NdPrFe_{17}$, was well reproduced in the as-quenched (aq) ribbon samples. X-ray diffraction (XRD) analysis [FIG. 1A] shows that the rhombohedral $Th_2Zn_{17}$-type crystal structure [space group R-3m with unit cell parameters a=8.553(3) Å and c=12.543(1) Å, and cell volume V=794.7(1) $Å^3$] is the major phase formed in the as-solidified ribbons. It must be noted that the XRD pattern exhibits low intensity and broad diffraction lines suggesting that the size of crystallites in the samples is small. In comparison with (Pedro Gorria, et al., J. Phys D: Appl. Phys., Vol. 41 (2008) 192003; Pedro Gorria, et al., Acta Materialia, Vol. 57 (2009) 1724-1733; Pablo Álvarez, et al., J. Phys.: Condens. Matter Vol. 22 (2010) 216005.), wherein the 2:17 phase is only formed in bulk $R_2Fe_{17}$ alloys with R=Nd or Pr, after a long thermal annealing (i.e. several days) at a temperature above 1273 K, it is worthy of mention that in the as-solidified alloy ribbons fabricated the 2:17 phase forms after a one-step rapid solidification process (i.e., as-solidified ribbons were not thermally annealed). This difference is relevant for the purposes of the instant invention, since a one-step process is a competitive advantage towards fabrication costs and energy saving. The low-field temperature dependence of the magnetization M(T), shown in FIG. 1B, reveals that the 2:17 phase of the instant invention shows a Curie temperature of 303 K; in addition, this phase coexists with a secondary magnetic phase having a broad magnetic transition located at 332 K (see top inset of FIG. 1B, which shows the dM/dT vs. temperature curve). Hence, in the obtained alloy ribbons two magnetic phases coexist.

FIG. 2A and its inset show typical low-magnification SEM micrographs of the ribbons cross-section. From these images, we can estimate that the ribbon thickness is around 20 μm and also that the ribbon morphology at this length scale consists of different shaped entities with average size of tens of nanometers. High-resolution transmission electron microscopy (HRTEM) observations (FIGS. 2B-2D) show that $NdPrFe_{17}$ alloy ribbons are nanostructured. As observed in FIGS. 2B and 2C, the ribbons are composed of nanograins whose size roughly varies between 7 and 15 nm. It must also notice that nanograins are surrounded by an intergranular phase. The fast Fourier transform (FFT) patterns for both, an individual 2:17 nanograin and the intergranular surrounding phase are given in the insets of FIGS. 2C and 2D, respectively. Hence, a two-phase magnetic nanocomposite system is formed in the $NdPrFe_{17}$ ribbons (consisting of 2:17 nanoparticles surrounded by an intergranular amorphous phase). The HRTEM images given in FIGS. 2C and 2D provide a more detailed view of the ribbon morphology at the nanometer length scale. As FIG. 2C shows, the dark granular regions observed in FIG. 2B are individual nanocrystalline grains for which well-defined lattice planes can be observed. The selected areas Fourier transform patterns for both regions (shown in the insets of both figures) further confirm the amorphous nature of the intergranular region as well as the crystallinity of the nanograins. The Fourier transform shown in the inset of FIG. 2C shows a $NdPrFe_{17}$ crystal in [010] orientation. In contrast, FIG. 2D puts in evidence the atomic disorder of the intergranular phase. Hence, a two-phase magnetic nanocomposite system is formed in the ribbons due to the fast solidification procedure and consists of $NdPrFe_{17}$ nanocrystals surrounded by a thin intergranular amorphous phase, as it was previously presumed from the XRD pattern and low-field M(T) analysis.

Magnetocaloric Properties

The magnetocaloric properties of the ribbons produced were evaluated from the magnetic entropy change as a function of the temperature curves, $\Delta S_M(T)$. They were obtained by numerical integration of the Maxwell relation $$\Delta S_M(T, \mu_o H) = \mu_o \int_0^{\mu_o H_{max}} \left[\frac{\partial M(T, \mu_o H')}{\partial T}\right]_{\mu_o H'} dH'$$

from a set of isothermal magnetization curves $M(\mu_o H)$ measured up to a maximum applied magnetic field $\mu_o H_{max}$ of 2 T. The magnetic field was applied along the major length of the ribbon samples to minimize the demagnetizing field effect. The refrigerant capacity RC, which measures the thermal efficiency of a magnetocaloric material in the energy transfer from cold to hot reservoirs for an ideal thermodynamic cycle, was estimated using the following the three following methods: RC-1=$|\Delta S_M^{peak}|\times\delta T_{FWHM}$, RC-2=$\int_{T_{cold}}^{T_{hot}}[\Delta S_M(T)]_{\mu_o\Delta H}$ dt, and RC-3 by maximizing the product $|\Delta S_M|\times\Delta T$ below the $\Delta S_M(T)$ curve (usually referred to as the Wood and Potter method) [M. E. Wood and W. H. Potter, Cryogenics, Vol. 25 (1985) 667-683]. In the case of RC-1 and RC-2, $T_{hot}$ and $T_{cold}$ are the temperatures that define the temperature interval $\delta T_{FWHM}$ of the full width at half maximum of the $\Delta S_M(T)$ curve (i.e., $\delta T_{FWHM}=T_{hot}-T_{cold}$). The latter defines the working temperature interval of the magnetic material as magnetocaloric refrigerant.

Figure 4:
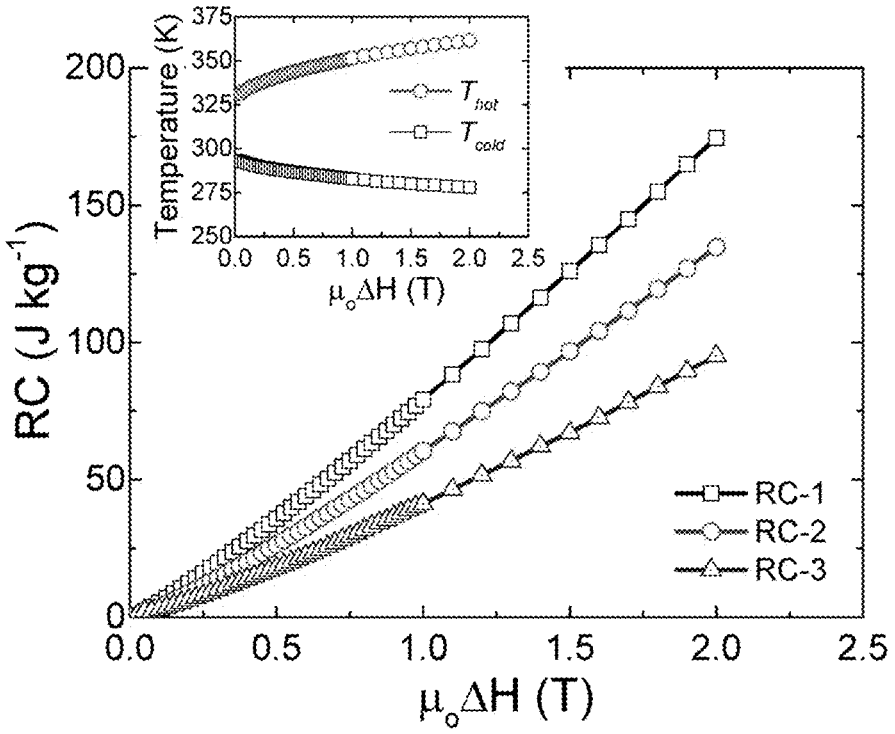
FIG. 4 shows a graph with the refrigerant capacities RC-1, RC-2, and RC-3 as a function of the magnetic field change for as-solidified $NdPrFe_{17}$ alloy ribbons. Inset: field dependence of the temperatures $T_{hot}$ and $T_{cold}$ that define $\delta T_{FWHM}$ (i.e., the full-width at half-maximum of the $\Delta S_M(T)$ curve).
Figure 5:
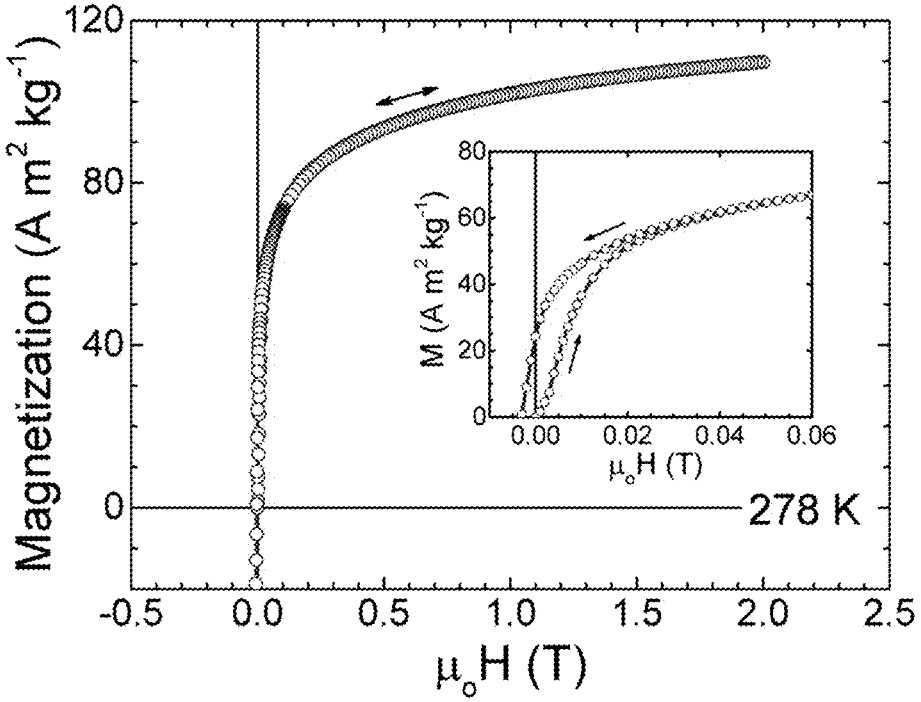
FIG. 5 shows a graph with the initial and demagnetization curves in the first quadrant measured at 278 K up to $\mu_o H=2$ T. Inset: low-field region of the curves.

FIG. 3 shows the $\Delta S_M(T)$ curves for a magnetic field change of 1.5 and 2.0 T for the fabricated alloys ribbons; for the sake of comparison the curves reported in reference 2 for bulk polycrystalline $Pr_2Fe_{17}$ alloys are plotted. Notice that $NdPrFe_{17}$ aq ribbons exhibit a lower peak value of the magnetic entropy change $\Delta S_M^{peak}$ but a well broader $\Delta S_M(T)$ curve [the normalized $\Delta S_M(T)/\Delta S_M^{peak}$ versus $T/T_C$ curves are given in the inset of FIG. 3; the broadening of the magnetic entropy change curve for the nanocomposite ribbons is 78% higher than $Pr_2Fe_{17}$ alloys at $\mu_o\Delta H=2$ T]. The $\Delta S_M(T)$ the field dependence of $T_{hot}$ and $T_{cold}$ is given in inset of FIG. 4; notice that $\Delta T_{FWHM}$ embraces the room temperature interval. Despite the lower $|\Delta S_M^{peak}|$ of the ribbon samples they show a larger refrigerant capacity and working temperature range in comparison with bulk $Pr_2Fe_{17}$ alloys (an increase in RC-1 and RC-2 at $\mu_o\Delta H=2$ T of approximately 17 and 12%, respectively, is found). The reversible character of the magnetocaloric effect was confirmed by measuring the first quadrant of the hysteresis loop of ribbon samples at $T_{cold}$ (i.e., 278 K), which is depicted in FIG. 5. The sample shows an intrinsic coercivity $\mu_oH_C$ of 3 mT, a remanence-to-saturation ratio of 0.2 and a negligible hysteresis loss at this temperature (0.007 J $kg^{-1}$); given by the area enclosed between the virgin and demagnetization curve in the first quadrant).

Hence, within the operating temperature range $\delta T_{FWHM}$, no significant hysteresis losses were measured in agreement with the second-order character of the phase transitions. As a result, these two-phase nanostructured amorphous $NdPrFe_{17}$ melt-spun ribbons yield to a reinforcement of the refrigerant capacity of the system owing to the Curie temperature of both phases are close to each other.

The magnetocaloric properties of both materials, i.e., $NdPrFe_{17}$ melt-spun ribbons and bulk $Pr_2Fe_{17}$ alloys, for magnetic field changes of 1.5 and 2.0 T are compared in Table I. A summary of the magnetocaloric properties of the dual-phase $NdPrFe_{17}$ nanocomposite is given in Table II.

TABLE I shows the maximum magnetic entropy change $|\Delta S_M^{peak}|$, useful working temperature range ($\delta T_{FWHM}=T_{cold}-T_{cold}$), and refrigerant capacities RC-1 and RC-2, for a magnetic field change of 1.5 and 2.0 T for as-solidified $NdPrFe_{17}$ alloy ribbons compared to the reported values for bulk $Pr_2Fe_{17}$ alloy [Pedro Gorria, et al., Acta Materialia, Vol. 57 (2009) 1724-1733].

TABLE I

| Sample | $T_C$ (K) | $\mu_o\Delta H$ (T) | $\lvert\Delta S_M^{max}\rvert$ (J $kg^{-1}$ $K^{-1}$) | $T_{cold}$ (K) | $T_{hot}$ (K) | $\delta T_{FWHM}$ (K) | RC-1 (J $kg^{-1}$) | RC-2 (J $kg^{-1}$) |
|---|---|---|---|---|---|---|---|---|
| Aq $NdPrFe_{17}$ | 303 | 1.5 | 1.6 | 280 | 357 | 77 | 126 | 97 |
| | | 2.0 | 2.1 | 278 | 362 | 84 | 175 | 135 |
| $Pr_2Fe_{17}$ bulk | 285 | 1.5 | 2.6 | 265 | 305 | 40 | 105 | 80 |
| | | 2.0 | 3.2 | 263 | 310 | 47 | 150 | 110 |

TABLE II shows a peak magnetic entropy change $|\Delta S_M^{peak}|$, RC-1, RC-2, $\delta T_{FWHM}$, $T_{cold}$, $T_{cold}$, RC-3, $\Delta T^{RC-3}$, and $T_{hot}$ and $T_{cold}$ related to RC-3 for as-solidified $NdPrFe_{17}$ alloy ribbons.

TABLE II

| $NdPrFe_{17}$ - as quenched ribbons | | | | |
|---|---|---|---|---|
| $\mu_o\Delta H$ (T) | 0.5 | 1.0 | 1.5 | 2.0 |
| $\lvert\Delta S_M^{peak}\rvert$ (J $kg^{-1}$ $K^{-1}$) | 0.6 | 1.1 | 1.6 | 2.1 |
| RC-1 (J $kg^{-1}$) | 36 | 79 | 126 | 175 |
| RC-2 (J $kg^{-1}$) | 26 | 60 | 97 | 135 |
| $\delta T_{FWHM}$ (K) | 57 | 69 | 77 | 84 |
| $T_{hot}$ (K) | 344 | 352 | 357 | 362 |
| $T_{cold}$ (K) | 287 | 283 | 280 | 278 |
| RC-3 (J $kg^{-1}$) | 18 | 41 | 67 | 95 |
| $\Delta T^{RC-3}$ (K) | 63 | 129 | 132 | 134 |
| $T_{hot}$ (K)* | 347 | 372 | 376 | 379 |
| $T_{cold}$ (K)* | 284 | 243 | 244 | 245 |

*related to RC-3.

The magnetocaloric nanocomposite obtained in melt-spun $NdPrFe_{17}$ alloy ribbons exhibits two successive second-order ferromagnetic phase transitions that come from the rhombohedral $Th_2Zn_{17}$-type nanocrystallites and a minor amorphous intergranular phase, respectively. The dual-magnetic phase character of the system gives rise to a broad magnetic entropy change curve with a well larger working temperature range of 84 K and a higher refrigerant capacity around room temperature if compared with their crystalline bulk counterpart.

It must be noted that $\delta T_{FWHM}$ at 2 T is superior to other magnetic refrigerants in the room-temperature range including the benchmark MC material Gd ($\delta T_{FWHM}$ for Gd is typically of approximately 40-45 K).

The use of melt spinning technique avoids the use of a prolonged thermal annealing at high temperatures to produce the 2:17 phase as major phase.

EXAMPLES

Method for Preparing the Magnetocaloric Material

The magneto caloric material of the invention (ribbons), with nominal composition $NdPrFe_{17}$, was produced by rapid solidification using a melt spinning system at a linear speed of the copper wheel of 20 $ms^{-1}$ from bulk pellets previously produced by arc melting. As raw materials, pure metallic elements were used (≥99.9%). Both the arc melted starting alloys and the melt-spun ribbons were obtained under a highly pure Ar atmosphere.

Characterization Methods

X-ray diffraction (XRD) patterns of finely powdered ribbon samples were collected with a Bruker AXS model D8 Advance X-ray powder diffractometer using Cu—$K_{alpha}$ radiation ($\lambda$=1.5418 Å, 20°≤2θ≤100°; step increment 0.01°). The Rietveld analysis of the diffraction data was carried out with the Fullprof suite package. Microstructure and elemental composition were investigated using a Helios FEI Dual beam Helios Nanolab FIB scanning electron microscope (SEM) equipped with and energy dispersive spectroscopy (EDS) system. SEM images were taken on the cross-section of cleaved ribbon samples; the granular microstructure of many ribbons was analysed. The images showing the nanostructure of the samples were collected in a FEI Tecnai™ high-resolution transmission electron microscope (HR-TEM). For TEM examination a tiny amount of finely grounded ribbons were put into a vial with ethanol. The vial was sonicated in an ultrasonic bath for 10 min to form a suspension.

A drop of the upper part of the suspension was applied to a copper grid that was dried in air).

Magnetic measurements were performed by vibrating sample magnetometry in a 9 Tesla Quantum Design PPMS® EverCool®-I platform. The magnetic field $\mu_o H$ was applied along the ribbon axis (i.e., the rolling direction) to minimize the demagnetizing field effect. The low-field (5 mT) and high-field (5 T) magnetization as a function of temperature, M(T), curves were measured between 100 and 400 K. The magnetic transition temperatures were obtained from the minimum of the dM/dT(T) curve measured under $\mu_o H$=5 mT. In order to determine the $\Delta S_M(T)$ curve from numerical integration of the Maxwell relation $$\left(\text{i.e., } \Delta S_M(T, \mu_o H) = \mu_o \int_0^{\mu_o H_{max}} \left[\frac{\partial M(T, \mu_o H')}{\partial T}\right]_{\mu_o H'} dH'\right),$$

a set of isothermal magnetization curves, $M(\mu_o H)$, was measured in the temperature range of 200-400 K with a ΔT step of 5 K up to a maximum applied magnetic field of 2 T. With the aim of minimizing the error in the calculation of $\Delta S_M$, the magnetization was measured for a large number of selected values of $\mu_o H$ at each temperature. The values of RC-1, RC-2, and RC-3 were obtained from the criteria stated above (in the section of magnetocaloric properties).

What is claimed is:

1. A magnetocaloric material comprising:

a $NdPrFe_{17}$ melt spun ribbon;

wherein said magnetocaloric material is a nanocrystallites phase surrounded by an intergranular amorphous phase;

wherein the magnetocaloric material is adapted to be used as a magnetic refrigerant.

2. The magnetocaloric material according to claim 1, wherein each element is in stoichiometric proportions.

3. The magnetocaloric material according to claim 1, wherein the magnetocaloric material shows two successive second-order ferromagnetic phase transitions.

4. The material according to claim 3, wherein said transitions are 303 and 332 K.

5. The material according to claim 3, wherein said transitions come from a rhombohedral $Th_2Zn_{17}$-type nanocrystallites and a minor amorphous intergranular phase.

6. The material according to claim 1, wherein said magnetocaloric material has a magnetic entropy change curve with a working temperature range $-\delta T_{FWHM}$ of 84 K at $\mu_o \Delta H$=2 T.

7. A method of manufacture a magnetocaloric $NdPrFe_{17}$ alloy, according to claim 1 comprising the step of:

melt-spinning the alloy to form a ribbon having a two phase microstructure including a nanoscale crystalline phase and an amorphous phase.

8. The method according to claim 7, wherein the melt spinning step is includes a rapid solidification in which the ribbons are form by ejecting a molten metallic alloy onto a rotating copper wheel in Ar atmosphere.

* * * * *